US006507323B1

(12) United States Patent
West

(10) Patent No.: US 6,507,323 B1
(45) Date of Patent: Jan. 14, 2003

(54) HIGH-ISOLATION POLARIZATION DIVERSE CIRCULAR WAVEGUIDE ORTHOMODE FEED

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/820,269

(22) Filed: Mar. 28, 2001

(51) Int. Cl.[7] ..... H01Q 13/00
(52) U.S. Cl. ..... 343/772; 343/786
(58) Field of Search ..... 343/772, 786, 343/776, 783; H01Q 13/00

(56) References Cited

U.S. PATENT DOCUMENTS 3,351,944 A * 11/1967 Dunn et al. ..... 343/786
4,041,499 A * 8/1977 Liu et al. ..... 343/756
4,528,528 A * 7/1985 Augustin ..... 343/786
5,229,736 A * 7/1993 Adams et al. ..... 343/786
5,245,353 A * 9/1993 Gould ..... 343/786
5,305,000 A * 4/1994 Harris ..... 343/786
5,305,001 A * 4/1994 Wong et al. ..... 343/786

* cited by examiner

*Primary Examiner*—Hoanganh Le
(74) *Attorney, Agent, or Firm*—Nathan O. Jensen; Kyle Eppele

(57) ABSTRACT

A high-isolation polarization diverse circular waveguide orthomode feed apparatus capable of supporting any arbitrary linear, right-hand circular, left-hand circular or elliptically polarized electromagnetic wave with desirable performance over a broad range of frequencies and small size is disclosed. The waveguide feed employs the combination of a circular waveguide segment, stepped septum polarizer, and a novel arrangement of diametrically opposed electric field probes in the bifurcated region of the circular waveguide segment to achieve low crosspolarization when operating in arbitrary linear mode and high-isolation for rejection of undesired cross-polarization components when operating in circular or elliptical polarization mode. This apparatus is an elegant, simple, compact, rugged, and cost effective design that is applicable to a broad family of microwave antennas, but in particular those required to meet minimal radome swept volume requirements.

19 Claims, 6 Drawing Sheets

HIGH-ISOLATION POLARIZATION DIVERSE CIRCULAR WAVEGUIDE ORTHOMODE FEED

BACKGROUND OF THE INVENTION

The present invention relates to microwave radio frequency waveguide feed systems, and more particularly to a high-isolation and polarization diverse circular waveguide orthomode feed for reception of Direct Broadcast Satellite (DBS) television and Internet satellite downlink services that operate worldwide.

The widespread demand for high-quality video, audio, and data communications via satellite has resulted in the need for additional bandwidth and better cross polarization rejection as well as reduced interference from noise or adjacent frequency operation. As a result, satellite broadcast systems are operating over broader and higher frequency ranges and implementing sophisticated methods to reduce interference and improve the intelligibility of communication signals that limit their operating capability. However, the radio frequency apparatus that operate at higher frequencies and with broader bandwidth require considerable design attention and often result in multiple and complicated waveguide feeds in order to account for electric and magnetic field behavior that exists inside the microwave waveguides that propagate their signals.

Also, in order to maintain reliable communication, transmit and receive systems must possess polarization compatibility and be of rugged design. Polarization compatibility is that property of a radiated wave of an antenna that describes the shape and orientation of the electric field vector as a function of time. It further complicates the waveguide feed design because electromagnetic energy may be transmitted in arbitrary linear, right-hand circular, left-hand circular, or elliptical polarization. Reliable system performance must be maintained while satisfying mechanical requirements for structural mounting and small size. This includes careful selection of electrical system components such as tuning studs or screws that are used on-board aircraft or satellite platforms that are particularly susceptible to the vibration and shock environment that jeopardize performance and erode component reliability.

It is well known in the art that square waveguides produce mode patterns that allow high efficiency injection or removal of energy for linear polarized electromagnetic waves using probe coupling, which results in orthogonal linear polarizations of high-isolation needed to reduce noise and unwanted adjacent frequency interference. A popular method of transforming linearly polarized signals into a circular polarized signal and vice versa in square waveguides is accomplished by using septum polarizers. The septum conversion process provides a 90° differential phase shift between two propagating orthogonal linearly polarized electromagnetic waves. Satellite systems, however, typically operate with circular polarization, which propagates well in circular waveguides, but generates undesirable cross polarization components and poor isolation when using orthogonal probe coupling methods in planar orientation. Thus, reduced propagation efficiency and increased attenuation of radiated signal intelligence occurs.

In order for optimum antenna efficiency, gain, and signal-to-noise ratio, the cross polarization components that result in a circular waveguide from the two orthogonal polarizations that comprise the elliptically polarized wave must be minimized. Methods in the art to condition the circular polarized wave and minimize cross polarization components employ elaborate conversion schemes that transform the elliptically polarized electromagnetic waves by using polarity converters, filters, circular-to-rectangular waveguide transitions, and multiply configured septum polarizers and tuning studs, each of which are difficult to design, operate with poor stability in harsh environments, and possess high cost and large size.

The present invention is a microwave feed assembly of simple, elegant, rugged, and scalable design that incorporates the desirable characteristics of broadband operation, polarization diversity, high-isolation between the orthogonal linear polarizations using septum polarizer methods, low insertion losses, small size, and applicability to a broad family of antennas.

SUMMARY OF INVENTION

The present invention relates to a high-isolation and polarization diverse circular waveguide orthomode feed for microwave frequency antennas. In one aspect of the invention, the waveguide feed supports transmission or reception of any arbitrary linear, right-hand circular, left-hand circular, or elliptical polarized microwave signal while achieving desirable performance over a wide range of frequencies with small size. In another aspect of the invention, the waveguide feed incorporates high cross-polarization rejection of unwanted linear cross polarization components when operating in arbitrary linear mode. In yet another aspect of the invention, the waveguide feed employs high probe-to-probe isolation for rejection of undesired cross-polarization when operating in circular or elliptical polarization mode. A waveguide feed assembly is disclosed, which comprises a combination of a circular waveguide segment, septum polarizer, and a novel arrangement of planar electric field probes positioned in the septum bifurcated region to achieve high-isolation, broad bandwidth, and polarization diversity.

It is an object of the present invention to provide a microwave waveguide feed system that can transmit or receive arbitrary linear, right-hand circular, left-hand circular, or elliptically polarized electromagnetic waves.

It is another object of the present invention to provide a microwave waveguide feed system that will support operation over a broad range of frequencies.

It is yet another object of the present invention to provide a microwave waveguide feed system with probe-to-probe isolation when rejecting undesired linear cross polarization of the two orthogonal linear polarizations that comprise circular or elliptical polarized electromagnetic waves.

It is yet another object of the present invention to operate in a non-radiating application such as a conversion from circular waveguide to a coaxial waveguide.

It is a feature of the present invention to provide a waveguide assembly that is polarization diverse for operation with arbitrary linear, right-hand circular, left-hand circular, or elliptically polarized electromagnetic waves.

It is another feature of the present invention to provide a compact, reliable, and simple to manufacture waveguide assembly that uses common materials and is suitable for reflector type antennas used to meet minimal radome swept volume applications by reducing the axial length of the waveguide assembly.

It is an advantage of the present invention to provide a waveguide assembly that is low cost, rugged, and applicable to a broad family of microwave antennas.

It is another advantage of the present invention to provide a microwave waveguide feed that can operate as a stand-alone microwave antenna system.

It is yet another advantage of the present invention to provide a waveguide assembly that incorporates design characteristics that are scalable to any frequency of microwave operation.

These and other objects, features, and advantages are disclosed in the specification, figures, and claims of the present invention.

DETAILED DESCRIPTION

Figure 1:
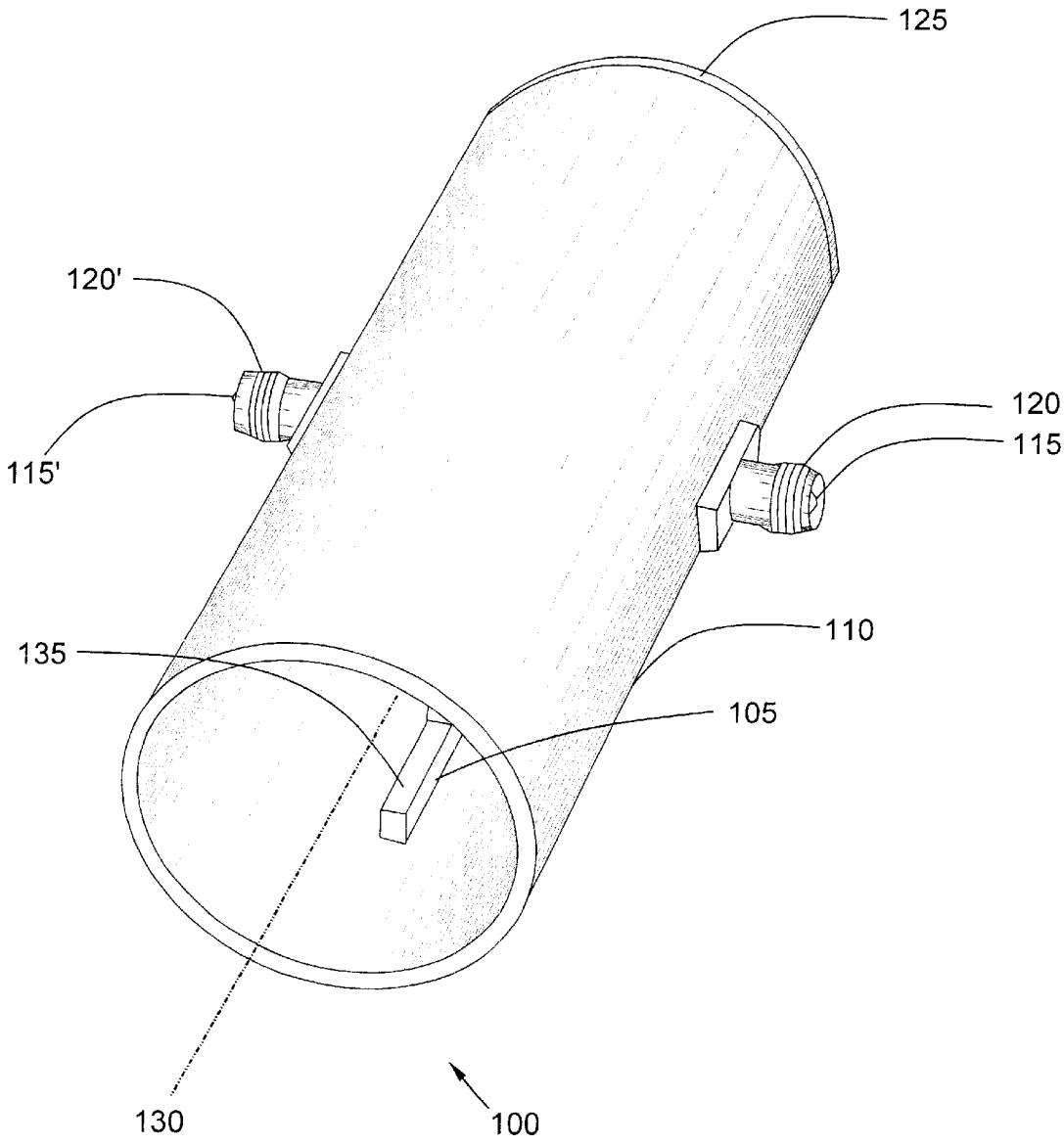
FIG. 1 is a perspective view of the high-isolation polarization diverse circular waveguide orthomode feed constructed in accordance with the preferred embodiments of the present.

Referring now to the drawings wherein like numerals refer to like matter throughout, FIG. 1 shows a perspective view of the high-isolation polarization diverse orthomode waveguide feed assembly 100 that incorporates the teachings of the present invention. The embodiment of FIG. 1 will be described with reference to communication signals that are transmitted or received in arbitrary linear, right-hand circular, left-hand circular, or elliptical polarization. It is to be understood, however, that the invention is suitable for any arbitrarily polarized electromagnetic wave transmit or receive system for which waveguides may be selected to meet the criteria described in detail herein.

In FIG. 1, the microwave energy of the desired frequency range is shown to propagate through the circular waveguide along the direction of the dotted line 130 in a conventional manner. Circular waveguide section 110 is provided to form an aperture for receiving or transmitting electromagnetic energy of a desired frequency range, a coupling means to minimize attenuation of the propagated electromagnetic microwave energy of the desired frequency range while providing a transition means for injection or removal of electromagnetic energy from the waveguide, and is selected to have-length and diameter sufficient to meet desired radiation properties of gain, beam width, cross-polarization or the like. Circular waveguide termination wall 125 is provided as a means to contain electromagnetic energy within the waveguide, present a low impedance reference plane for electromagnetic energy of the desired frequency range, and is selected to have a diameter sufficient to dispose concentrically with circular wave-guide section 110.

Figure 2A:
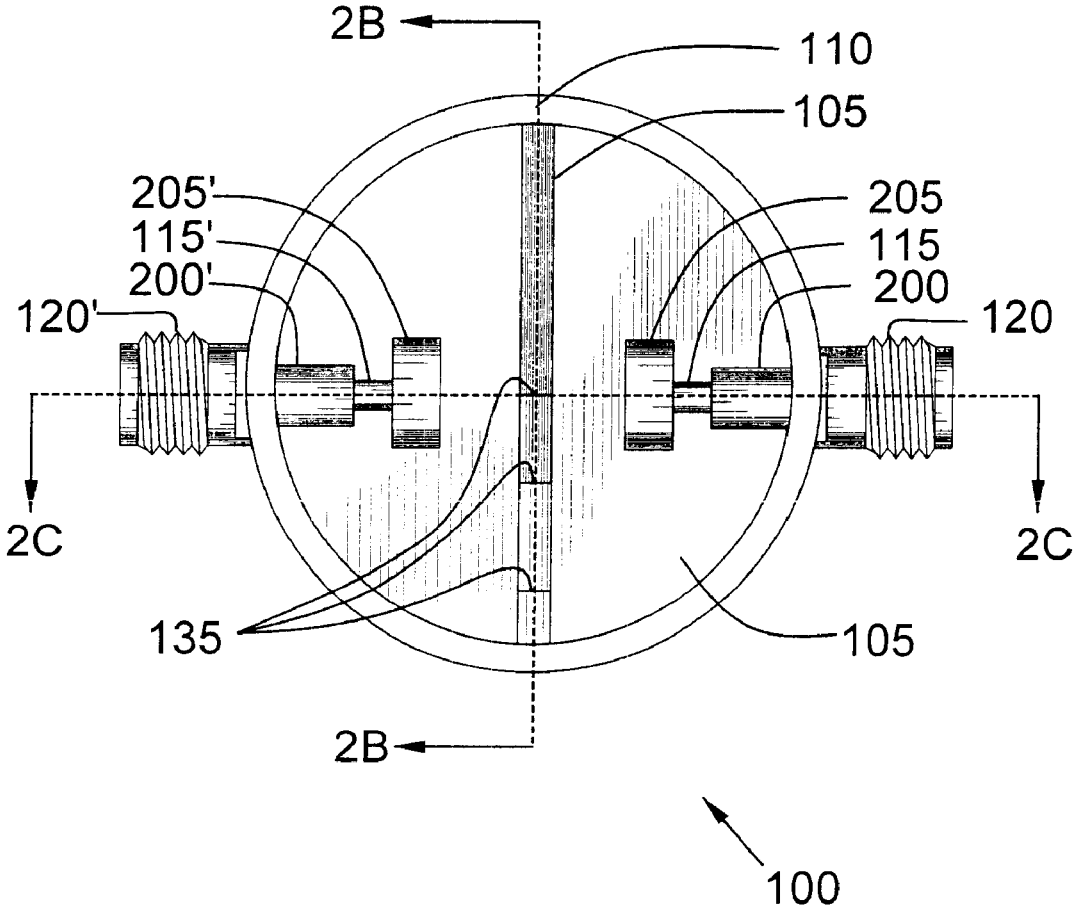
FIG. 2A is front view of the high-isolation polarization diverse circular waveguide orthomode feed in FIG. 1 having an exemplary view of component orientation and layout.
Figure 2B:
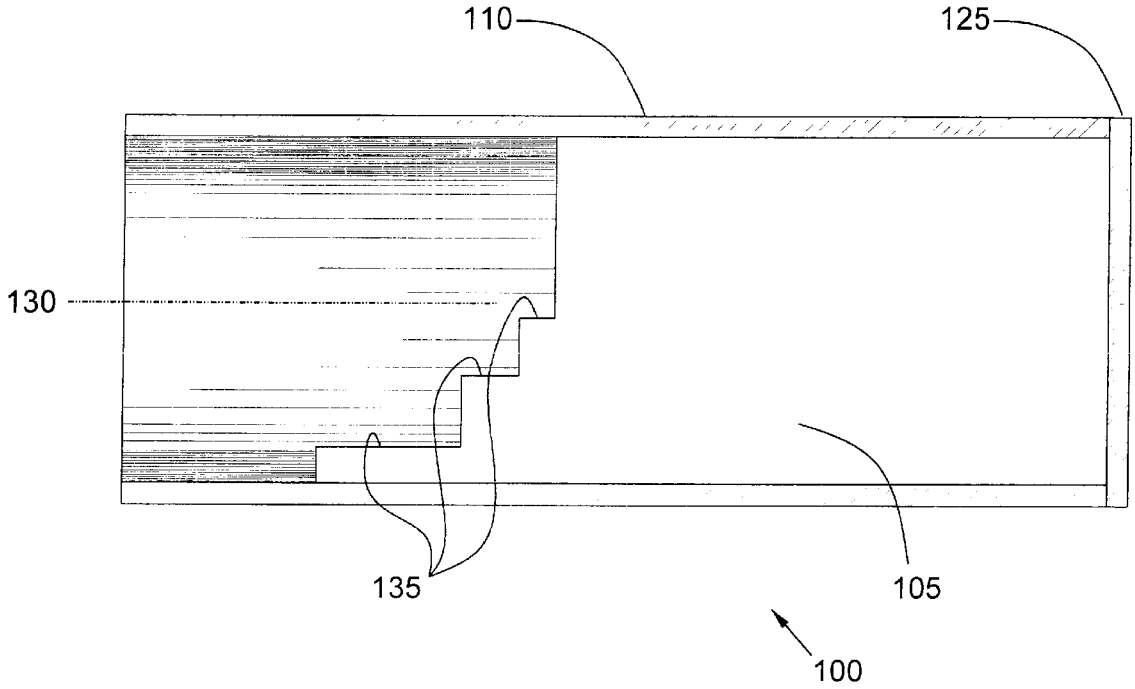
FIG. 2B is a side cross-section view of the high-isolation polarization diverse circular waveguide orthomode feed in FIG. 1 having a exemplary view of component orientation and layout.
Figure 2C:
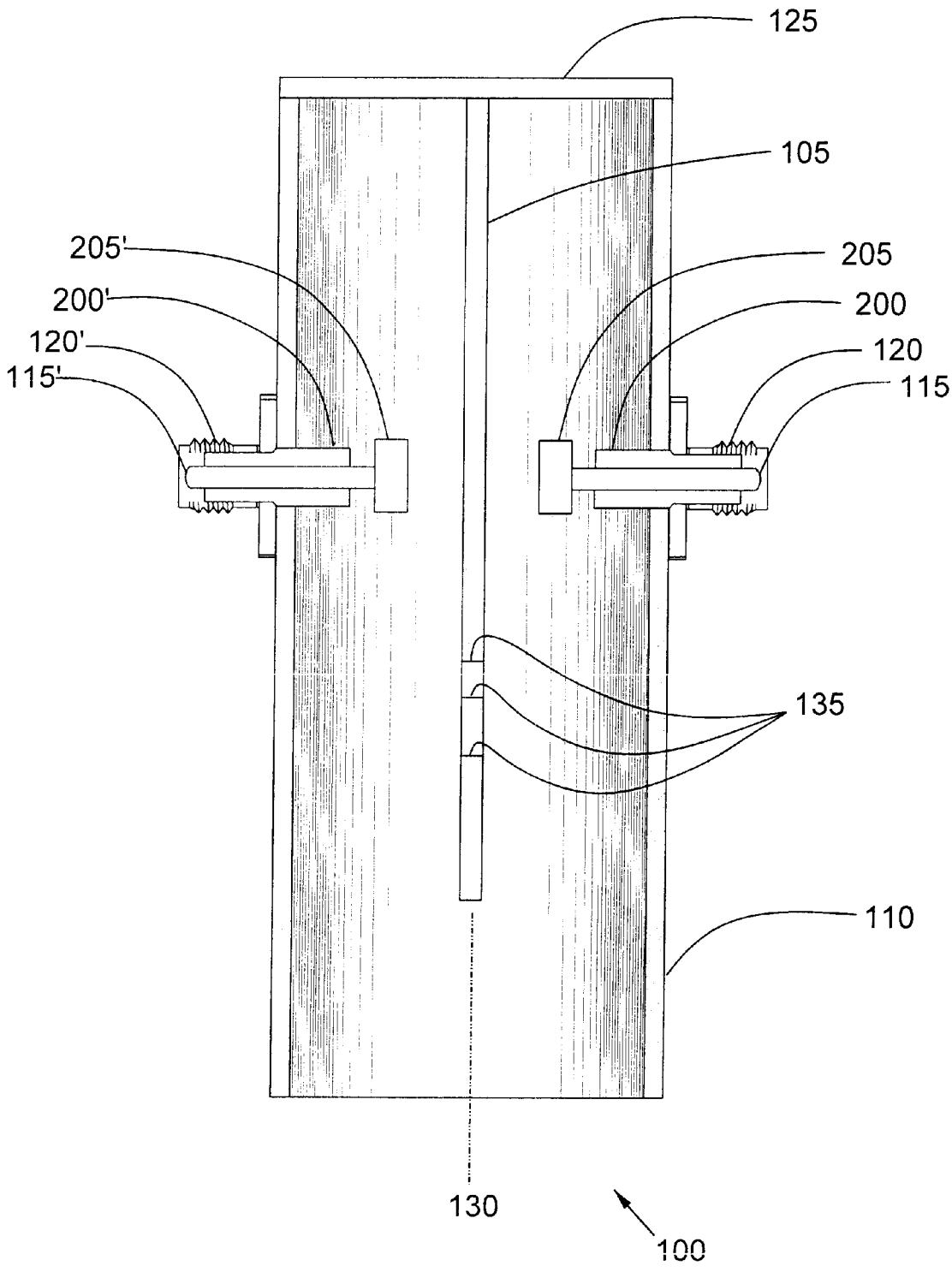
FIG. 2C is a top cross-section view of the high-isolation polarization diverse circular waveguide orthomode feed in FIG. 1 having an exemplary view of component orientation and layout.

Referring again to FIG. 1 and the section and cutaway views of FIG. 2, a bifurcation region within waveguide section 110 is equipped with an asymmetrically step-shaped septum 105 that is provided to form a dividing means that divides the waveguide section 110 into first and second waveguide sections for electromagnetic signals of the dominant mode. The septum 105 comprises a plurality of steps 135 ascending in the direction of the dotted line 130 from a first point located on one side near the aperture of circular waveguide section 110 extending to a second point on the opposite side of waveguide section 110. The first and second points are spaced from one another relative to the direction of microwave signal propagation in such a manner as to minimize attenuation of the propagated electromagnetic microwave energy of the desired frequency range illuminating the waveguide aperture. Septum steps 135 are transverse to the direction of microwave propagation 130 and are chosen to optimize the mode-matching characteristics within the frequency band of operation. The intersecting waveguide elements 105, 110, and 125 may be fabricated in integral unitary relationship from a single piece of metal, casting, or by fusible metals or methods, with material of sufficient conductivity for the frequency of operation and sufficient strength for the intended purpose by those persons skilled in the microwave art.

Referring again to FIG. 1, there is shown in the wall of circular waveguide section 110 signal cable connectors (120 and 120'), highly linear radio frequency (RF) electric (E)-field probes (E-field Probe-1 115 and E-field Probe-2 115'). The signal cable connectors (120 and 120') provide a signal transition means for the electromagnetic energy that is injected or removed from circular waveguide section 110 by the E-field probes (115 and 115'). However, signal transition means accomplished by the signal cable connectors (120 and 120') may take a number of forms, such as by direct connection to low noise amplifiers (LNA) or transmitter printed circuit boards, which are readily apparent to one of ordinary skill in the art, to avoid any impedance discontinuity. E-field probes (115 and 115') are axially aligned in diametrically opposite relationship and positioned orthogonal to the plane of septum 105 within the bifurcated region to provide a means for signal detection of electromagnetic energy within waveguide section 110.

Referring again to the section and cutaway views of FIG. 2, there are shown insulating sleeves (200 and 200') comprising a suitable dielectric material known in the art surrounding the E-field probes (115 and 115') shafts. The thickness, length, and type of dielectric material chosen for the insulating sleeves (200 and 200') and the center pin length and diameter for the E-field probes (115 and 115') are chosen to provide optimal impedance matching over the useful bandwidth of electromagnetic energy of the desired frequency range. Affixed concentrically to the tip of E-field probes (115 and 115') are electrically and physically coupled isotropic E-field probe enhancements (205 and 205'), which are fabricated from metal of sufficient conductivity for the frequency of operation, and having size and shape chosen to provide a means to increase the bandwidth of the electromagnetic energy propagating in circular waveguide section 110.

It should now be noted that the diametrically opposite relationship and orthogonal positioning of the E-field probes (115 and 115') with respect to septum 105 within the bifurcated region of circular waveguide section 110 is a novel aspect of this invention that not only permits the electromagnetic signal extraction, but more importantly results in the polarization diverse characteristics of this high-isolation waveguide orthomode feed assembly 100. In order that this aspect of the invention may be properly understood and appreciated, it is essential to first examine the structure that defines the sense of electromagnetic wave polarization.

Figure 3A:
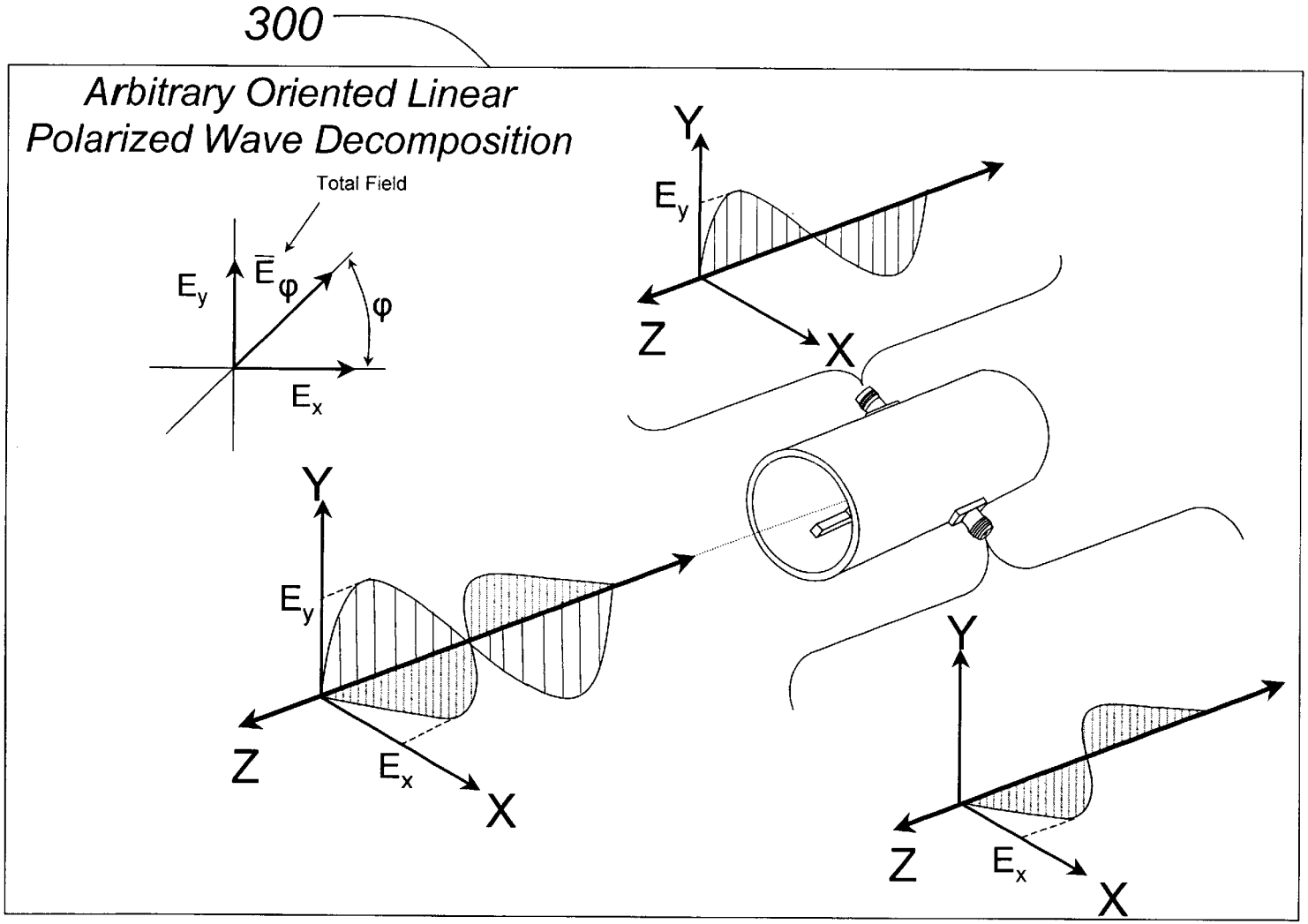
FIG. 3A is an example illustration of arbitrary oriented linear polarized wave decomposition and electromagnetic signal extraction methodology for an embodiment of the FIG. 1 waveguide feed.

There is shown in FIG. 3 diagrams of the means by which electromagnetic signal energy is extracted by the E-field probes (115 and 115') from circular waveguide section 110. It is a well known relationship that an arbitrary electric field, that oscillates on a straight line within a X–Y reference plane perpendicular to the transmission direction, can be resolved into two orthogonal components, $E_x$, electric field strength in the X-direction, and $E_y$, electric field strength in the Y-direction, that are aligned with a reference coordinate system. FIG. 3A depicts an example illustration 300 of arbitrary orientated linear polarized wave decomposition, or the simultaneous reception of perpendicular vertical and horizontal polarizations, that can be described by two linear orthogonal E-field components Ex and Ey, which may have amplitude difference, but no phase variation.

Figure 3B:
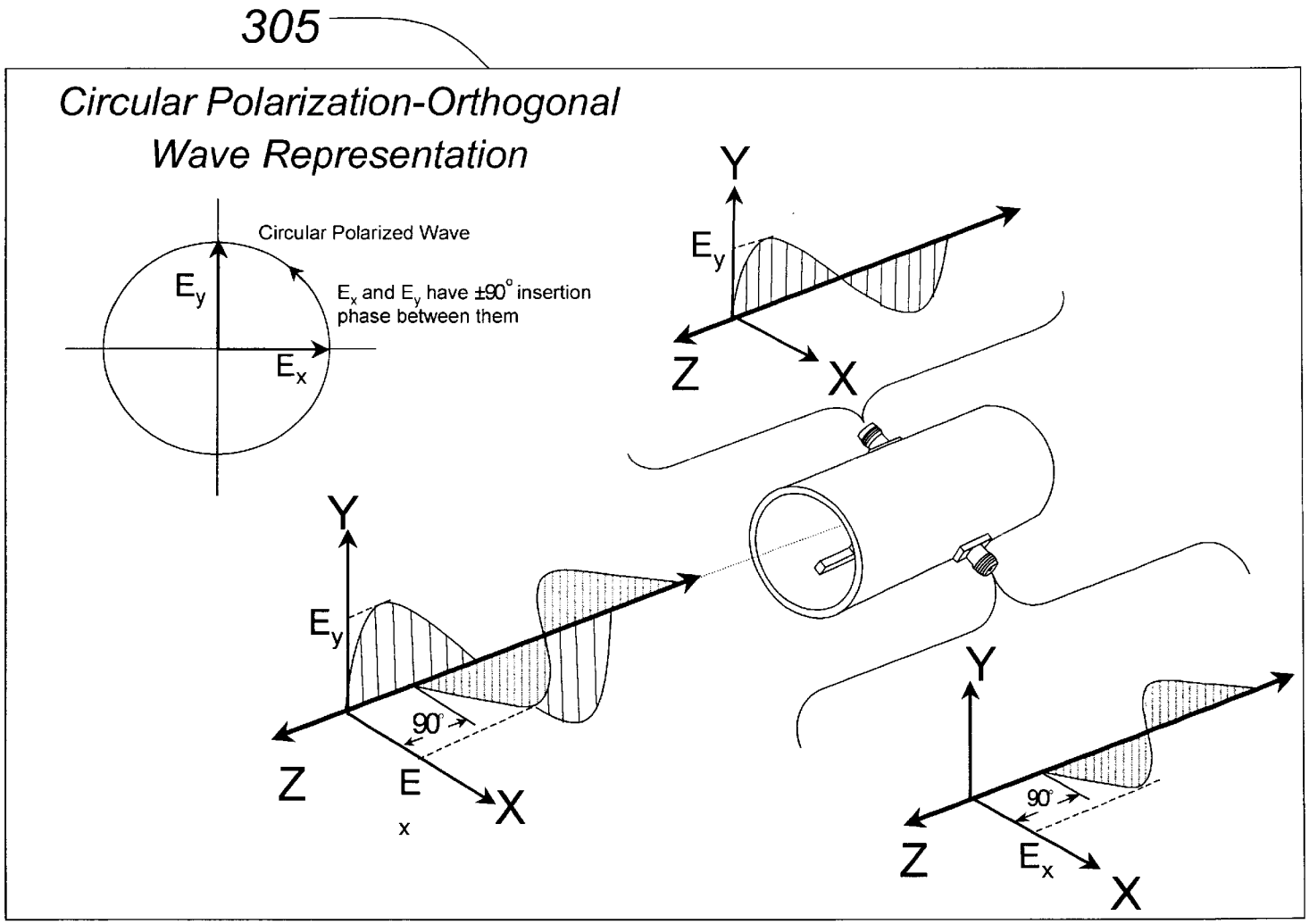
FIG. 3B is a first example illustration of circular polarization orthogonal wave representation, decomposition, and electromagnetic signal extraction methodology for a first embodiment of the FIG. 1 waveguide feed.

Additionally, FIG. 3B shows another example illustration 305 of how a perfectly circular polarized wave can be described by two linear orthogonal field components, $E_x$ and $E_y$, which exhibit identical magnitude and a phase difference of 90. When the phase difference is +90° the electromagnetic wave is right-hand circular polarized (RHCP), while a phase difference of −90° indicates a left-hand circular polarized (LHCP) electromagnetic wave.

Referring again to FIG. 1 and to the cutaway and section views of FIG. 2, it is readily seen the arrangement of the E-field probes (115 and 115') and septum polarizer 105 permits linear decomposition of any elliptically polarized electromagnetic wave into a first component detected by E-field Probe-1 115, and a second component detected by E-field Probe-2 115', both having amplitude and phase, which together determine the polarization angle of the electromagnetic wave in circular waveguide section 110. The arrangement of E-field probes (115 and 115') within the bifurcated septum region, positioning of septum 105, and configuration and number of septum steps 135 permits high isolation between the linear decomposed electromagnetic waves detected by the probes and optimizes the waveguide's frequency band of operation.

It is understood that, while the detailed drawings, specific examples, and particular values given describe preferred exemplary embodiments of the present invention, they are for the purpose of illustration only. The apparatus and method of the present invention is not limited to the precise details of the conditions disclosed. Accordingly, changes may be made to the details disclosed without departing from the spirit of the invention the scope of which should be determined by the following claims.

I claim:

1. A circular waveguide antenna feed comprising:

a circular waveguide section having a diameter for supporting electromagnetic waves of desired frequency range from a source there of;

a circular waveguide termination wall having a diameter of said circular waveguide section and affixed concentrically for providing a low impedance (short) for detected signal components of said desired frequency range electromagnetic waves;

a step-shaped septum dividing the circular waveguide section into first and second waveguide sections each of which is capable of supporting propagation of the desired frequency range electromagnetic waves; and a pair of electric field probes disposed in diametrically opposite arrangement affixed to and protruding into said first and second waveguide sections for output of linear orthogonal detected signal components of general elliptical polarized electromagnetic waves of the desired frequency range;

wherein said pair of electric field probes protrusion is orthogonal to and equal distance from said step-shaped septum.

2. The antenna feed in accordance with claim 1, including signal transition means coupled to the pair of electric field probes for the transmission of the linear orthogonal signal components of the desired frequency range electromagnetic waves from the first and second waveguide sections.

3. A circular waveguide antenna feed comprising:

a circular waveguide section having a diameter for supporting electromagnetic waves of desired frequency range from a source thereof;

a circular waveguide termination wall having a diameter of said circular waveguide section and affixed concentrically for providing a low impedance (short) for detected signal components of said desired frequency range electromagnetic waves;

a step-shaped septum having a plurality of asymmetrically ascending steps oriented in a direction transverse to the direction of electromagnetic wave propagation in the circular waveguide section extending from one side to the opposite side of the circular waveguide section dividing the circular waveguide section and said circular waveguide termination wall into substantially equal first and second waveguide sections each of which is capable of supporting propagation of the desired frequency range electromagnetic waves; and a pair of electric field probes disposed in diametrically opposite arrangement affixed to and protruding into said first and second waveguide sections for output of first and second linear orthogonal detected signal components of general elliptical polarized electromagnetic waves of the desired frequency range;

wherein said pair of electric field probes protrusion is orthogonal to and equal distance from said step-shaped septum.

4. The antenna feed in accordance with claim 3, including signal transition means coupled to the pair of electric field probes for the transmission of said first and second linear polarized detected signal components of the desired frequency range from the first and second waveguide section.

5. The antenna feed of claim 3 wherein said diametrically opposite arrangement of the electric field probe pair within the first and second waveguide sections corresponds to minimizing undesirable cross-polarization components of linear polarized signals while maximizing rejection of unwanted linear cross polarization of the linear orthogonal detected signal components that comprise elliptically polarized electromagnetic waves of the desired frequency range electromagnetic waves by each electric field probe.

6. The antenna feed of claim 3 wherein the pair of electric field probes comprises:

a pair of insulating sleeves affixed to the pair of electric field probes for impedance matching of the detected signal components of the desired frequency range electromagnetic waves; and a pair of electric field probe enhancements affixed to the electric field probe tips for increasing the bandwidth of the detected signal components of the desired frequency range electromagnetic waves.

7. The antenna feed of claim 6 wherein said impedance matching corresponds to adjusting the thickness, length, and type of dielectric material of said pair of insulating sleeves.

8. The antenna feed of claim 6 wherein the impedance matching corresponds to adjusting center pin length and diameter of the electric field probes.

9. The antenna feed of claim 6 wherein said increase in bandwidth corresponds to adjusting diameter and thickness of said electric field probe enhancements.

10. A circular waveguide antenna feed comprising:

a circular waveguide section having a diameter for supporting electromagnetic waves of desired frequency range from a source thereof;

a circular waveguide termination wall having a diameter of said circular waveguide section and affixed concentrically to an output end for providing a low impedance (short) for detected signal components of said desired frequency range electromagnetic waves;

a step-shaped septum having a plurality of asymmetrically ascending steps oriented in a direction transverse to the direction of electromagnetic wave propagation in the circular waveguide section extending from a first point on one side to a second point on the opposite side of the circular waveguide section dividing the circular waveguide section and said circular waveguide termination wall into substantially equal first and second waveguide sections each of which is capable of supporting propagation of the desired frequency range electromagnetic waves;

wherein said first point being located near the aperture of the circular waveguide section and said second point on the opposite side of the circular waveguide section spaced from the first point in the direction of microwave signal propagation;

a first electric field probe affixed to and protruding into said first waveguide section orthogonal to said step-shaped septum for output of first detected polarized signal component of the desired frequency range;

a first electric field probe low-loss dielectric insulating sleeve affixed to said first electric field probe for impedance matching of said first detected polarized signal component of the desired frequency range;

a first electric field probe enhancement affixed to the first electric field probe for increasing bandwidth of the first detected polarized signal component of the desired frequency range;

a first signal transition means coupled to the first electric field probe for transmission of the first detected polarized signal component of the desired frequency range from the first waveguide section;

a second electric field probe diametrically opposite to the first electric field probe affixed to and protruding into the second waveguide section for output of second detected polarized signal component of the desired frequency range;

a second electric field probe low-loss dielectric insulating sleeve affixed to said second electric field probe for impedance matching of said second detected polarized signal component of the desired frequency range;

a second electric field probe enhancement affixed to the second electric field probe for increasing bandwidth of the second detected polarized signal component of the desired frequency range; and a second signal transmission means coupled to the second electric field probe for transmission of the second detected polarized signal component of the desired frequency range from the second waveguide section.

11. The antenna feed of claim 10 wherein the electromagnetic waves are of arbitrary linear, right-hand circular, left-hand circular, or elliptical polarization.

12. The antenna feed of claim 10 wherein the circular waveguide section is chosen to meet desired radiation properties of gain, beam width, and cross polarization.

13. The antenna feed of claim 10 wherein the step-shaped septum first and second point positioning are chosen in such a manner as to minimize attenuation of the propagated electromagnetic microwave energy of the desired frequency range illuminating the circular waveguide section.

14. The antenna feed of claim 10 wherein the step-shaped septum bifurcation region extends from the second point to the circular waveguide termination wall.

15. The antenna feed of claim 10 wherein the first and second electric field probes are center pin extensions of a coaxial connector.

16. The antenna feed of claim 10 wherein the first electric field probe is approximately positioned centrally in the first waveguide section formed by the step-shaped septum.

17. The antenna feed of claim 10 wherein the second electric field probe is approximately positioned centrally in the second waveguide section formed by the step-shaped septum.

18. The antenna feed of claim 10 wherein the first and second electric field probes protrude equal distance into the first and second waveguide section cavities respectively.

19. The antenna feed of claim 10 wherein said first and second electric field probe enhancement comprises:

a circular disk approximately 20 mils in length and thickness; wherein said circular disk is affixed concentrically to the tip of the electric field probe.

* * * * *